United States Patent [19]

Karino

[11] 3,994,131

[45] Nov. 30, 1976

[54] VORTICAL FLOW AFTERBURNER DEVICE

[75] Inventor: Kimiji Karino, Katsuta, Japan

[73] Assignee: Hitachi, Ltd., Japan

[22] Filed: May 12, 1975

[21] Appl. No.: 576,373

Related U.S. Application Data

[63] Continuation of Ser. No. 390,706, Aug. 23, 1973, abandoned.

[30] Foreign Application Priority Data

Aug. 30, 1972 Japan ..... 47-86141
Apr. 16, 1973 Japan ..... 48-42166

[52] U.S. Cl. ..... 60/303; 23/277 C
[51] Int. Cl.[2] ..... F01N 3/14
[58] Field of Search ..... 60/303, 307; 23/277 C

[56] References Cited

UNITED STATES PATENTS

| | | | |
|---|---|---|---|
| 3,197,956 | 8/1965 | Clarke | 60/303 |
| 3,311,456 | 3/1967 | Denny | 60/303 |
| 3,577,728 | 5/1971 | Brimer | 60/303 |
| 3,802,194 | 4/1974 | Tanasawa | 60/303 |
| 3,804,597 | 4/1974 | Inoue | 60/301 |
| 3,805,523 | 4/1974 | Tanasawa | 60/307 |

*Primary Examiner*—Douglas Hart
*Attorney, Agent, or Firm*—Craig & Antonelli

[57] ABSTRACT

A vortical flow afterburner device for causing afterburning of engine exhaust gases by mixing air with same, in which the exhaust gas flow is supplied substantially tangentially into a precombustion chamber disposed on the upstream side of a reaction chamber for producing a vortical flow of the exhaust gases, this vortical flow being then supplied into the central portion of the reaction chamber, and air is supplied substantially tangentially into the reaction chamber to insure combustion of the exhaust gases.

5 Claims, 7 Drawing Figures

VORTICAL FLOW AFTERBURNER DEVICE

This is a continuation of application Ser. No. 390,706, filed Aug. 3, 1973, now abandoned.

This invention relates to afterburner devices for burning unburned combustible components included in automobile exhaust gases thereby obviating pollution of air by such components, and more particularly to a vortical flow afterburner device in which streams of exhaust gases and afterburning air are supplied into a reaction chamber in the circumferential direction.

There are various demands for an afterburner device of this kind. These demands include prevention of damage to the wall surface of the reaction chamber of the afterburner device due to high temperature gases produced by the afterburning of exhaust gases, prevention of damage to the exhaust gas igniter due to the afterburning of exhaust gases, efficient afterburning of exhaust gases within the reaction chamber, and reduction in the size of the afterburner device.

A vortical flow afterburner system proposed hitherto satisfies the above demands to a certain degree and comprises supplying engine exhaust gases into a reaction chamber in the circumferential direction to produce a whirling stream of exhaust gases in the reaction chamber, supplying afterburning air into the reaction chamber in the axial direction, and igniting the mixture of these gases by an igniter disposed in the reaction chamber. This afterburner system is effective in preventing damage to the wall surface of the reaction chamber and to the igniter due to combustion of gases and reduction in the efficiency of combustion. According to this afterburner system, a lean exhaust gas-air mixture is produced in the central portion of the reaction chamber and the concentration of the exhaust gas-air mixture is increased toward the inner wall surface of the reaction chamber such that an incombustible excessively concentrated exhaust gas-air mixture occupies the zone in the vicinity of the wall surface of the reaction chamber thereby protecting the wall of the reaction chamber, igniter and other elements against high temperature gases. Further, due to the fact that the exhaust gas flow makes whirling movement within the reaction chamber, combustion of the exhaust gases continues over a long period of time and combustion efficiency can be improved thereby.

However, a combustible concentrated exhaust gas-air mixture may be produced in the vicinity of the wall surface of the reaction chamber and may be burned to impart damage to the wall surface of the reaction chamber and to the igniter when the concentration distribution of the exhaust gas-air mixture in the reaction chamber deviates from the desired distribution in such a manner as to produce a combustible exhaust gas-air mixture adjacent to the wall surface of the reaction chamber. Further, the reaction chamber must be very large in size in order that the velocity of air supplied in the axial direction of the afterburner device is less than 2 m/sec.

It is therefore a primary object of the present invention to provide a small-sized vortical flow afterburner device in which undersirable damage to the wall surface of the reaction chamber and to the igniter due to combustion of gases can be avoided and efficient afterburning of exhaust gases can take place throughout the reaction chamber.

A vortical flow afterburner device according to the present invention is featured by disposing a precombustion chamber on the upstream side of a reaction chamber, supplying exhaust gas flow into this precombustion chamber so that such flow whirls in the circumferential direction of the precombustion chamber, igniting the exhaust gases by an igniter disposed within the precombustion chamber, supplying the burning gas flow into the reaction chamber, and directing afterburning air into the reaction chamber from an outer peripheral portion of the reaction chamber in a direction substantially tangent to the reaction chamber.

Other objects, features and advantages of the present invention will be apparent from the following detailed description of a preferred embodiment thereof taken in conjunction with the accompanying drawing, in which.

Figure 5:
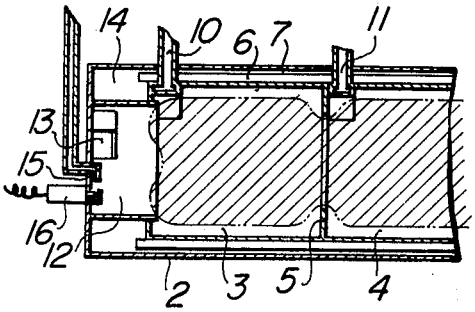
Figure 6:
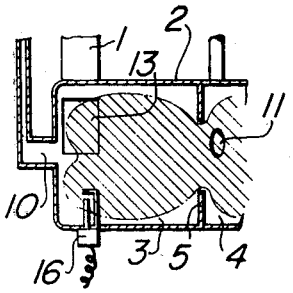
FIG. 6 PRIOR ART
Figure 7:
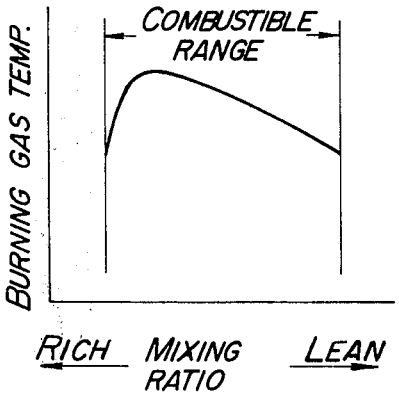

FIG. 5 shown schematically the flame distribution in the vortical flow afterburner device of the present invention;

FIG. 6 shows schematically the flame distribution in a prior art vortical flow afterburner device; and FIG. 7 is a graph showing the relation between the mixing ratio of exhaust gases to air and the burning gas temperature in an afterburner device.

Figure 1:
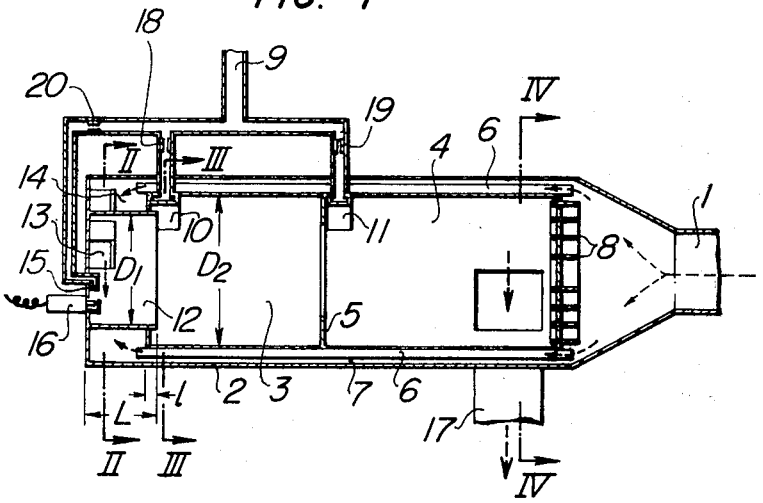
FIG. 1 is a schematic sectional view of parts of a vortical flow afterburner device embodying the present invention.
Figure 4:
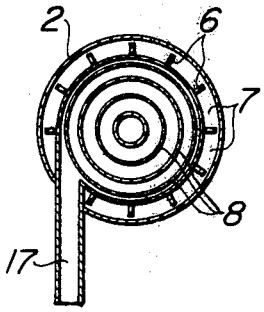
FIG. 4 is a section taken on the line IV—IV in FIG. 1.

Referring to FIGS. 1 to 4, a vortical flow afterburner device according to the present invention includes an exhaust gas inlet 1 for receiving an exhaust gas flow including unburned combustible components from an engine exhaust port (not shown). A first reaction chamber 3 and a second reaction chamber 4 are disposed in a cylindrical outer casing 2 of the vortical flow afterburner device. The second rection chamber 4 communicates with the first reaction chamber 3 through an orifice plate 5. A plurality of axially extending plate fins 6 are disposed in an annular space 7 defined between the outer casing 2 and the first and second reaction chambers 3 and 4. A plurality of annular fins 8 extend concentrically in an axial direction from the closed end of the second reaction chamber 4 as shown in FIGS. 1 and 4 so that they can preheat the exhaust gases supplied from the exhaust gas inlet 1. A secondary air inlet 9 is provided for supplying afterburning air into the vortical flow afterburner device. This secondary air inlet 9 communicates with the discharge port of an air pump which may be driven by the engine. A first air nozzle 10 opens into the first reaction chamber 3 at a position adjacent to an opening of a precombustion chamber 12 described later so that the afterburning air directed from the first air nozzle 10 can make whirling movement in the circumferential direction of the first reaction chamber 3. A second air nozzle 11 opens into the second reaction chamber 4 so that the afterburning air directed from the second air nozzle 11 can make whirling movement in the circumferential direction of the second reaction chamber 4.

Figure 2:
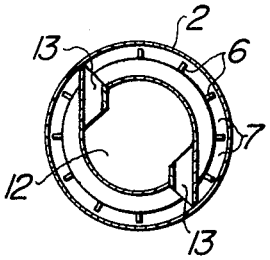
FIG. 2 is a section taken on the line II—II in FIG. 1.
Figure 3:
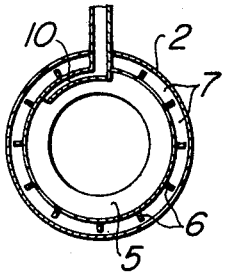
FIG. 3 is a section taken on the line III—III in FIG. 1.

This second air nozzle 11 opens into the second reaction chamber 4 at a position immediately behind or downstream of the orifice plate 5. The first and second air nozzles 10 and 11 communicate with the secondary air inlet 9. A precombustion chamber 12 is disposed on the upstream side of the first reaction chamber 3 and its opening communicates with the first reaction chamber 3. A pair of exhaust gas nozzles 13 open into the precombustion chamber 12 so that the exhaust gas flow passed through the annular space 7 between the outer casing 2 and the first and second reaction chambers 3 and 4 can be directed into the precombustion chamber 12 in the form of a stream whirling in the circumferential direction of the precombustion chamber 12. These exhaust gas nozzles 13 are disposed opposite to each other as shown in FIG. 2 so as to assist in producing a vortical flow of the exhaust gases. A space 14 is provided between the outer casing 2 and the precombustion chamber 12 for turning the axial flow of the exhaust gases passed through the annular space 7 into a radial flow so that the exhaust gases can easily flow into the exhaust gas nozzles 13. An igniting air nozzle 15 communicates with the secondary air inlet 9 and opens into the precombustion chamber 12 at a position adjacent to an igniter 16 extending into the precombustion chamber 12. An exhaust gas outlet 17 is provided adjacent to the closed end of the second reaction chamber 4 and communicates with the atmosphere through suitable means such as a muffler (not shown).

In operation, the flow of exhaust gases emitted from the engine under operation is supplied into the vortical flow afterburner device through the exhaust gas inlet 1. The exhaust gas flow passes through the annular passage 7 defined between the outer casing 2 and the first and second reaction chambers 3 and 4 to be directed from the exhaust gas nozzles 13 into the precombustion chamber 12 in the form of a stream whirling in the circumferential direction of the precombustion chamber 12. Thus a vortical flow of the exhaust gases is produced and makes whirling movement within the precombustion chamber 12.

Air supplied from the secondary air inlet 9 connected to the air pump is forced through the igniting air nozzle 15 into the precombustion chamber 12 and is mixed with the exhaust gases to produce a combustible exhaust gas-air mixture within the precombustion chamber 12. The igniting air is forced from the igniting air nozzle 15 into the precombustion chamber 12 in such a direction that a positively whirling flow is produced in the precombustion chamber 12. The combustible exhaust gas-air mixture produced within the precombustion chamber 12 is then ignited by the igniter 16. The temperature of the burning mixture is of the order of 600° C to 700° C in the vicinity of the center of the precombustion chamber 12 and is of the order of 500° C in the vicinity of the igniter 16. The igniter 16 is substantially free from any damage with such a temperature.

The mixture of exhaust gases and air in the precombustion chamber 12 makes whirling movement within the precombustion chamber 12, and while maintaining such a state, the mixture is supplied into the central portion of the first reaction chamber 3. The diameter of the vortical flow of the mixturee in this case is substantially equal to the diameter $D_1$ of the precombustion chamber 12.

According to experimental results, the ratio $D_1/D_2$ between the diameter $D_1$ of the precombustion chamber 12 and the diameter $D_2$ of the first reaction chamber 3 is preferably of the order of 0.3 to 0.95 although it varies depending on the selection of the first reaction chamber 3. Further, the axial length L of the precombustion chamber 12 is desirably such that the exhaust gas flow directed from the exhaust gas nozzles 13 can make one complete whirling movement within the precombustion chamber 12. However, this length L may be shorter than that above described when the ratio $D_1/D_2$ between the diameter $D_1$ of the precombustion chamber 12 and the diameter $D_2$ of the first reaction chamber 3 is relatively small.

The distance $l$ between the end opening of the precombustion chamber 12 and the end of the first reaction chamber 3 remote from the second reaction chamber 4 lies within a wide range, but it is desirable that the ratio $l/L$ between this distance $l$ and the length L of the precombustion chamber 12 is of the order of 0.1 to 0.2. This is desirable in order that the air directed from the first air nozzle 10 may be allowed to freely flow to a certain extent within the first reaction chamber 3 and may not interfere with the vortical flow of the exhaust gas-air mixture flowing from the precombustion chamber 12 into the first reaction chamber 3.

The opening of the precombustion chamber 12 may not necessarily be disposed within the first reaction chamber 3. The flow rates of air directed from the first air nozzle 10, second air nozzle 11 and igniting air nozzle 15 are determined by orifices 18, 19 and 20 disposed in the conduits leading to the nozzles 10, 11 and 15 respectively. It is desirable that the flow rates of air through the second air nozzle 11 and igniting air nozzle 15 are of the order of ⅓ to ⅛ of the flow rate of air through the first air nozzle 10.

The exhaust gas-air mixture flowing into the central portion of the first reaction chamber 3 is mixed with afterburning air which is directed from the first air nozzle 10 into the first reaction chamber 3 adjacent to the opening of the precombustion chamber 12 is such a manner as to make whirling movement in the circumferential direction of the first reaction chamber 3. Since the afterburning air produces a vortex along the inner peripheral wall of the first reaction chamber 3, a layer of a combustible exhaust gas-air mixture is formed in the vicinity of the central portion of the first reaction chamber 3, while a layer of afterburning air is formed along the wall surface of the first reaction chamber 3, and thus so-called laminar combustion occurs in the first reaction chamber 3. The temperature of the burning mixture within the first reaction chamber 3 is of the order of 900° C to 1,100° C in the vicinity of the central portion and is of the order of 700° C to 750° C in the vicinity of the wall surface. Thus, damage to the wall surface due to exposure to extremely high temperature gases can be avoided.

The burning mixture is then supplied in a spiral flow pattern from the first reaction chamber 3 into the second reaction chamber 4 through the orifice plate 5. Afterburning air supplied from the air pump is forced through the second air nozzle 11 into the second reaction chamber 4 in the form of a circumferentially whirling stream so that laminar combustion of the burning mixture occurs in the second reaction chamber 4 again. The temperature of the burning mixture within the second reaction chamber 4 is lower by about 100° C to 200° C than that in the first reaction chamber 3 in both the central portion and the wall surface portion.

Due to the combustion of the exhaust gases in the first and second reaction chambers 3 and 4, the amount of the unburned combustible components contained in the exhaust gas-air mixture is remarkably reduced, and the exhaust gas flow processed in the manner above described is discharged to the atmosphere through the exhaust gas outlet 17 and muffler. The exhaust gas flow is substantially continuously supplied to the exhaust gas inlet 1 and passes through the fins 8 and 6 which are heated by the heat of the exhaust gases previously processed so that the exhaust gas flow can be preheated to a temperature high enough to promote the reaction within the reaction chambers.

While a vortical flow afterburner device having a first and a second reaction chamber has been described by way of example, the present invention is applicable to a vortical flow afterburner device having a single reaction chamber.

FIG. 5 shows the flame distribution of the burning exhaust gas-air mixture in the vortical flow afterburner device of the present invention. According to the present invention, a combustible concentrated exhaust gas-air mixture occupies the zone in the vicinity of the central portion of the reaction chambers and the concentration of the mixture is reduced toward the wall surface until a lean exhaust gas-air mixture occupies the zone in the vicinity of the wall surface. Thus, the wall surface is substantially free from damage due to exposure to extremely high temperature gases.

In the flame distribution in a prior art device as shown in FIG. 6, a lean exhaust gas-air mixture occupies the zone in the vicinity of the central portion of a first reaction chamber 3 and the concentration of the mixture is increased toward the wall surface until an excessively concentrated exhaust gas-air mixture which cannot be burned occupies the zone in the vicinity of the wall surface so as to protect the wall surface against exposure to high temperature gases. However, as will be apparent from FIG. 7 showing the relation between the mixing ratio of exhaust gases to secondary air and the burning gas temperature, the temperature of the mixture is very high in the range in which the proportion of the exhaust gases is large. Therefore, a combustible concentrated exhaust gas-air mixture may be formed in the vicinity of the wall surface of the first reaction chamber 3 and this wall surface may be exposed to high temperature gases when the concentration distribution of the exhaust gas-air mixture in the vortical flow produced within the chamber 3 deviates toward a lower concentration. In contrast, a lean exhaust gas-air mixture occupies the zone in the vicinity of the wall surface of the reaction chambers in the present invention, and the wall surface is substantially free from damage due to exposure to high temperature gases.

In the embodiment above described, igniting air is directed from the igniting air nozzle into the precombustion chamber in a direction in which the air makes positive whirling movement in the chamnber. However, the orifice disposed on the upstream side of the igniting air nozzle may be suitably selected and igniting air may be directed into the chamber in an axial direction.

What is claimed is:

1. A vortical flow afterburner device disposed midway of an engine exhaust conduit for receiving engine exhaust gases and mixing the exhaust gases with air thereby causing afterburning of the exhaust gases, comprising a hollow cylindrical reaction chamber, a cylindrically shaped precombustion chamber disposed on the upstream side of said reaction chamber and communicating with said reaction chamber through an opening, said precombustion chamber having a diameter smaller than that of said cylindrical reaction chamber, an exhaust gas nozzle for directing the engine exhaust gases into said precombustion chamber in such a direction that the exhaust gas stream makes whirling movement in the circumferential direction of said precombustion chamber, igniting means for igniting the exhaust gas stream within said precombustion chamber, igniting air nozzle means disposed in the precombustion chamber perpendicular to an imaginary radius of said precombustion chamber and spaced inwardly of a wall defining said precombustion chamber for supplying a small positively whirling stream of air tangentially into the precombustion chamber in the vicinity of the igniting means to be mixed with the exhaust gas stream, and an air nozzle disposed radially outward relative to said precombustion chamber to open into said reaction chamber adjacent to said opening of said precombustion chamber, from which the exhaust gas stream subjected to precombustion flows into said reaction chamber, for directing combustion supporting air into said reaction chamber in such a direction that the combustion supporting air stream makes whirling movement in the circumferential direction of said reaction chamber.

2. A vortical flow afterburner device as claimed in claim 1, wherein said reaction chamber is divided into a first and a second reaction chamber communicating with each other through an orifice plate, and a second air nozzle for directing combustion supporting air substantially tangentially into said second reaction chamber is disposed substantially immediately downstream of said orifice plate.

3. A vortical flow afterburner device as claimed in claim 1, wherein the ratio of the diameter of said precombustion chamber to that of said reaction chamber lies within the range of 0.3 to 0.95.

4. A vortical flow afterburner device as claimed in claim 1, wherein the axial length of said precombustion chamber is large enough to allow one complete whirling movement of exhaust gases within said precombustion chamber.

5. A vortical flow afterburner device as claimed in claim 1, wherein the ratio of the distance between the opening of said precombustion chamber communicating with said reaction chamber and the upstream side end of said reaction chamber to the axial length of said precombustion chamber lies within the range of 0.1 to 0.2.

* * * * *